US009804619B2

(12) United States Patent
Motoki

(10) Patent No.: US 9,804,619 B2
(45) Date of Patent: Oct. 31, 2017

(54) USB POWER SUPPLY APPARATUS

(71) Applicant: ROHM CO., LTD., Ukyo-Ku, Kyoto (JP)

(72) Inventor: Kenichi Motoki, Kyoto (JP)

(73) Assignee: ROHM CO., LTD., Ukyo-Ku, Kyoto (JP)

( * ) Notice: Subject to any disclaimer, the term of this patent is extended or adjusted under 35 U.S.C. 154(b) by 47 days.

(21) Appl. No.: 14/919,109

(22) Filed: Oct. 21, 2015

(65) Prior Publication Data

US 2016/0116928 A1 Apr. 28, 2016

(30) Foreign Application Priority Data

Oct. 24, 2014 (JP) ..... 2014-217688

(51) Int. Cl.

| | |
|---|---|
| ***G05F 1/571*** | (2006.01) |
| ***G05F 1/56*** | (2006.01) |
| ***G05F 1/565*** | (2006.01) |
| ***G05F 1/573*** | (2006.01) |
| ***H02M 3/156*** | (2006.01) |
| ***H02M 3/158*** | (2006.01) |
| ***G05F 1/575*** | (2006.01) |

(52) U.S. Cl.

CPC ..... *G05F 1/575* (2013.01)

(58) Field of Classification Search

CPC ..... H02M 2001/0025; H02M 3/156; H02M 3/158; H02M 3/1588; G05F 1/462; G05F 1/468; G05F 1/565; G05F 1/575; G05F 1/56; G05F 1/571; G05F 1/573

See application file for complete search history.

(56) References Cited

U.S. PATENT DOCUMENTS

| | | | | |
|---|---|---|---|---|
| 6,363,491 | B1 * | 3/2002 | Endo | G06F 13/4063 713/310 |
| 2010/0287399 | A1 * | 11/2010 | Yasuda | G06F 1/28 713/340 |
| 2011/0241627 | A1 * | 10/2011 | Arai | H02J 7/0031 320/162 |
| 2012/0023344 | A1 * | 1/2012 | Miyanaga | G06F 13/4072 713/310 |
| 2013/0002212 | A1 * | 1/2013 | Fan | H02M 3/1588 323/235 |

(Continued)

FOREIGN PATENT DOCUMENTS

| | | | |
|---|---|---|---|
| JP | 2006060977 | A | 3/2006 |
| JP | 2006304500 | A | 11/2006 |
| JP | 2013198262 | A | 9/2013 |

*Primary Examiner* — Timothy J Dole
*Assistant Examiner* — Sisay G Tiku
(74) *Attorney, Agent, or Firm* — Cantor Colburn LLP

(57) ABSTRACT

A USB power supply apparatus supplies electric power to a USB power reception apparatus. A bus line connects the output of the power supply circuit and the USB power reception apparatus. A switch is provided on a path of the bus line. A feedback circuit feedback controls the power supply circuit such that the output voltage $V_{OUT}$ of the power supply circuit approaches a reference voltage $V_{REF}$. A controller adaptively controls the reference voltage $V_{REF}$ based on an electrical state of the USB power supply apparatus.

13 Claims, 8 Drawing Sheets

(56) References Cited

U.S. PATENT DOCUMENTS

2013/0119922 A1* 5/2013 Chen ..... H02J 7/0021
320/107
2014/0103896 A1* 4/2014 Lee ..... H02M 3/158
323/282
2014/0122909 A1* 5/2014 Hawawini ..... H02J 7/0004
713/310
2014/0369085 A1* 12/2014 Motoki ..... G06F 1/266
363/21.12
2015/0100812 A1* 4/2015 Jing ..... G06F 1/266
713/340
2015/0198989 A1* 7/2015 Hayter ..... G06F 1/266
713/340
2015/0280612 A1* 10/2015 Ide ..... H02M 7/53871
363/98
2015/0311806 A1* 10/2015 Kim ..... H02M 3/33507
363/21.17
2015/0380924 A1* 12/2015 Ohwaki ..... H02H 3/0935
361/93.7
2016/0034333 A1* 2/2016 Ozawa ..... G06F 11/0757
713/300
2016/0225559 A1* 8/2016 Ueki ..... G06F 1/26

* cited by examiner

USB POWER SUPPLY APPARATUS

This application is based upon and claims the benefit of priority under 35 U.S.C. §119 from the prior Japanese Patent Application No. 2014-217688, filed Oct. 24, 2014, the entire contents of which are incorporated herein by reference.

BACKGROUND OF THE INVENTION

Field of the Invention

The present invention relates to a USB power supply apparatus.

Description of the Related Art

Battery-driven devices such as cellular phone terminals, tablet terminals, laptop computers, and portable audio players each include a chargeable secondary battery and a charger circuit that charges the secondary battery as built-in components. Known examples of such charger circuits include an arrangement that charges a secondary battery using a DC voltage (bus voltage $V_{BUS}$) supplied from an external circuit via a USB (Universal Serial Bus) cable.

At present, as a charger circuit mounted on a mobile device, charger circuits that conform to a specification which is referred to as the "USB Battery Charging Specification" (which will be referred to as the "BC specification" hereafter) have become mainstream. There are several kinds of USB hosts or USB chargers (which will collectively be referred to as a "USB power supply apparatus" hereafter). As the kinds of USB power supply apparatuses that conform to revision 1.2 of the BC specification, SDP (Standard Downstream Port), DCP (Dedicated Charging Port), and CDP (Charging Downstream Port) have been defined. The current (current capacity) that can be provided by a USB power supply apparatus is determined according to the kind of USB power supply apparatus. Specifically, DCP and CDP are defined to provide a current capacity of 1500 mA. Also, SDP is defined to provide a current capacity of 100 mA, 500 mA, or 900 mA, according to the USB version.

As a next-generation secondary battery charging method using USB, a specification which is referred to as the "USB Power Delivery Specification" (which will be referred to as the "PD specification" hereafter) has been developed. The PD specification allows the available power to be dramatically increased up to a maximum of 100 W, as compared with the BC standard, which provides a power capacity of 7.5 W. Specifically, the PD specification allows a USB bus voltage that is higher than 5 V (specifically, 12 V or 20 V). Furthermore, the PD specification allows a charging current that is greater than that defined by the BC specification (specifically, the PD specification allows a charging current of 2 A, 3 A or 5 A).

FIG. 1 is a block diagram showing a USB host 900 that conforms to the USB-PD specification investigated by the present inventors. A receptacle (USB port) 908 configured as a cable plug opening is connected via a USB cable 202 to a USB device (slave device, which will be referred to as a "USB power reception apparatus" hereafter) 200 that functions as a power supply destination. In the drawing, only a VBUS line and a GND line are shown.

A power supply circuit 902 generates a DC voltage $V_{OUT}$ to be supplied to the USB power reception apparatus 200. A feedback circuit 904 feedback controls the power supply circuit 902 such that an output voltage $V_{OUT}$ of the power supply circuit 902 approaches a setting voltage $V_{SET}$. With the USB-PD specification, the setting voltage $V_{SET}$ is selected from among 5 V, 12 V, and 20 V.

The output of the power supply circuit 902 and the receptacle 908 are connected to each other via a bus line 906. A switch SW1 and an inductor L1 are provided to the bus line 906 such that they are arranged in series. Furthermore, a smoothing output capacitor C1 is connected to the output of the power supply circuit 902. Moreover, an output capacitor C2 is connected in the vicinity of the receptacle 908.

A communication (COM) terminal of a controller 910 is coupled with the bus line 906 via a capacitor C3 for DC blocking. With the USB-PD specification, a modulation signal $V_{MOD}$ is superimposed on the bus voltage $V_{BUS}$, which allows the USB host 900 and the USB power reception apparatus 200 to communicate with each other via the bus line 906. The modulation signal $V_{MOD}$ thus superimposed is input to the COM terminal via the capacitor C3. The controller 910 determines the setting voltage $V_{SET}$ of the bus voltage $V_{BUS}$ based on the negotiation with the USB power reception apparatus 200. Furthermore, the controller 910 notifies the USB power reception apparatus 200 of the allowed value of the supply current (charging current) $I_{SUPPLY}$.

The USB-PD specification provides a larger allowed supply current $I_{SUPPLY}$ than that provided by the conventional BC specification. Thus, the USB-PD specification requires strict overcurrent protection and strict overvoltage protection. Specifically, in order to provide such circuit protection, the switch SW1 is provided. The controller 910 has an overcurrent protection function of turning off the switch SW1 when the current value of the supply current $I_{SUPPLY}$ exceeds an overcurrent threshold value. Also, the controller 910 has an overvoltage protection function of turning off the switch SW1 when the output voltage $V_{OUT}$ or otherwise the bus voltage $V_{BUS}$ exceeds an overvoltage threshold value.

As a result of investigating the USB host 900 shown in FIG. 1, the present inventor has come to recognize the following problem. That is to say, as the switch SW1, a power MOSFET (Metal Oxide Semiconductor Field Effect Transistor) is employed. However, a MOSFET having an on resistance of several mΩ is costly. Accordingly, in practice, in many cases, a MOSFET having an on resistance that exceeds several tens of mΩ is employed. In this case, a power supply path between the power supply circuit 902 and the receptacle 908 has an impedance on the order of 100 mΩ, which is estimated based on the inductor L1 and the impedance of the bus line 106 itself in addition to the on resistance of the MOSFET. Thus, the voltage drop $V_{DROP}$ is not negligible. Giving consideration to the voltage drop $V_{DROP}$, the bus voltage VBUT is represented by the following Expression (1).

$$V_{BUS}=V_{OUT}-V_{DROP} \quad (1)$$

For example, when a supply current $I_{SUPPLY}$ of 5 A flows through a resistor of 100 mΩ, the voltage drop becomes 500 mA, which is a large value. That is to say, in a case in which the power supply circuit 902 generates a voltage $V_{OUT}$ of 5 V, the bus voltage $V_{BUS}$ output from the receptacle 908 becomes lower, and specifically, becomes 4.5 V. With the USB-PD specification, in a case in which the setting voltage $V_{SET}$ is set to 5 V, the lower limit value of the bus voltage $V_{BUS}$ is defined to be 4.75 V. Accordingly, as the supply current $I_{SUPPLY}$ becomes larger, it becomes difficult for such an arrangement to satisfy the specification. The same problem can occur in the USB Type-C specification.

SUMMARY OF THE INVENTION

The present invention has been made in view of such a situation. Accordingly, it is an exemplary purpose of an embodiment of the present invention to provide a USB power supply apparatus with improved load regulation that suppresses voltage drop that occurs in a bus voltage output from a receptacle.

An embodiment of the present invention relates to a USB power supply apparatus that conforms to the USB (Universal Serial Bus) specification, and that supplies electric power to a USB power reception apparatus. The USB power supply apparatus comprises: a power supply circuit; a bus line that connects an output of the power supply circuit and the USB power reception apparatus; a switch provided on a path of the bus line; a feedback circuit that feedback controls the power supply circuit such that the output voltage of the power supply circuit approaches a reference voltage; and a controller that adaptively controls the reference voltage based on an electrical state of the USB power supply apparatus.

Such an embodiment is capable of preventing the bus voltage supplied to the USB power reception apparatus from dropping due to a voltage drop that occurs in a current supply path including the switch and the bus line. Thus, such an arrangement provides improved load regulation.

Also, the controller may control the reference voltage so as to reduce an amount of a drop in voltage from a predetermined setting voltage that occurs in a bus voltage at a position that is closer to the USB power reception apparatus side than the switch.

Also, the controller may comprise a bus voltage detection unit that detects the bus voltage. Also, the controller may control the reference voltage based on a detection result obtained by the bus voltage detection unit.

Such an arrangement is capable of directly detecting a drop in the bus voltage in a sure manner. Thus, such an arrangement is capable of adjusting the reference voltage according to the drop in the bus voltage thus detected.

Also, the bus voltage detection unit may compare the bus voltage with a first threshold voltage determined to be lower than the setting voltage, and generates a low voltage detection signal which is asserted when the bus voltage becomes lower than the first threshold voltage. Also, when the low voltage detection signal is asserted, the controller may raise the reference voltage by a predetermined voltage increment.

Such an arrangement is capable of preventing the bus voltage from dropping and becoming lower than the first threshold voltage.

Also, the reference voltage may be configured as a voltage obtained by superimposing a correction voltage on the setting voltage. Also, when the low voltage detection signal is asserted, the controller raises the correction voltage by a predetermined voltage increment.

With such an arrangement, when a voltage drop that occurs in the switch or the bus line is small, the correction voltage is set to zero. In this state, the bus voltage approaches the setting voltage. Conversely, when a voltage drop that occurs in the switch or the bus line is large, the correction voltage is raised. In this state, the bus voltage also approaches the setting voltage.

Also, the bus voltage detection unit may compare the bus voltage with a second threshold voltage that is set to the setting voltage or otherwise a value in the vicinity of the setting voltage. Also, the bus voltage detection unit may generate a voltage return signal that is asserted when the bus voltage exceeds the second threshold voltage. Also, when the voltage return signal is asserted, the controller may lower the reference voltage by a predetermined voltage decrement.

Such an arrangement is capable of resolving a state in which the bus voltage becomes higher than the second threshold voltage, i.e., a state in which the bus voltage becomes higher than the setting voltage.

Also, the reference voltage may be configured as a voltage obtained by superimposing a correction voltage on the setting voltage. Also, when the voltage return signal is asserted, the controller may reduce the correction voltage by a predetermined voltage decrement.

Also, when the voltage return signal remains in an asserted state for a predetermined judgment time, the controller may lower the reference voltage.

In a case in which the bus voltage temporarily fluctuates due to transient current fluctuation, such an arrangement is capable of preventing minute oscillation in the reference voltage. Thus, such an arrangement is capable of preventing the system from becoming unstable, and preventing the bus voltage from becoming lower than the lower limit voltage.

Also, the controller may further comprise a current detection unit that detects a supply current which is supplied to the USB power reception apparatus via the bus line. Also, the controller may control the reference voltage based on a detection result obtained by the current detection unit in addition to the detection result obtained by the bus voltage detection unit.

The smoothing capacitor connected to the bus line has a large capacitance. Accordingly, a delay occurs from the time point at which the supply current changes to the time point at which the bus voltage changes. In order to solve such a problem, the supply current is detected, and the change in the bus voltage is predicted. Such an arrangement is capable of adjusting the reference voltage based on the prediction before the bus voltage actually changes. Thus, such an arrangement provides improved responsiveness.

Also, the controller may further comprise an output voltage detection unit that detects an output voltage of the power supply circuit. Also, the controller may control the reference voltage based on a detection result obtained by the output voltage detection unit in addition to the detection result obtained by the bus voltage detection unit.

Such an arrangement is capable of detecting the voltage difference between the output voltage of the power supply circuit and the bus voltage. By adjusting the reference voltage according to the voltage difference thus detected, such an arrangement is capable of controlling the bus voltage such that it approaches the setting voltage.

Also, the controller may comprise a current detection unit that detects a supply current supplied to the USB power reception apparatus via the bus line. Also, the controller may control the reference voltage based on a detection result obtained by the current detection unit.

In a case in which the impedance of the current supply path including the switch and the bus line is known, the bus voltage can be estimated based on the supply current. Thus, such an arrangement is capable of controlling the reference voltage such that the bus voltage thus estimated approaches the setting voltage.

Also, the controller may comprise a voltage drop detection unit that detects a difference between an output voltage of the power supply circuit and a bus voltage at a position that is closer to the USB power reception apparatus side than the switch. Also, the controller may control the reference voltage based on a detection result obtained by the voltage drop detection unit.

Also, the reference voltage may be configured as a voltage obtained by superimposing a correction voltage on a predetermined setting voltage. Also, the controller may adjust the correction voltage so as to reduce an amount of a drop in voltage from a predetermined setting voltage that occurs in a bus voltage at a position that is closer than the USB power reception apparatus side than the switch.

Also, the controller may further comprise a communication unit that communicates with the USB power reception apparatus. Also, the controller may determine the setting voltage based on negotiation with the USB power reception apparatus.

Also, the USB power supply apparatus may conform to the USB-PD (Power Delivery) specification. Also, the USB power supply apparatus may further comprise an inductor provided at a position that is closer to the USB power reception apparatus side than the switch. Also, the controller may control the reference voltage so as to reduce an amount of voltage drop from a predetermined setting voltage that occurs in a bus voltage at a position that is closer to the USB power reception apparatus side than the inductor.

Such an arrangement is capable of controlling the reference voltage while giving consideration to a voltage drop that occurs at the inductor.

Also, the USB power supply apparatus may conform to the USB-PD (Universal Serial Bus-Power Delivery) specification or otherwise the USB Type-C specification.

Another embodiment of the present invention relates to an electronic device. The electronic device comprises any one of the aforementioned USB power supply apparatuses.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is connected to the member B" includes a state in which the member A is indirectly connected to the member B via another member that does not substantially affect the electric connection therebetween, or that does not damage the functions or effects of the connection therebetween, in addition to a state in which the member A is physically and directly connected to the member B.

Similarly, the state represented by the phrase "the member C is provided between the member A and the member B" includes a state in which the member A is indirectly connected to the member C, or the member B is indirectly connected to the member C via another member that does not substantially affect the electric connection therebetween, or that does not damage the functions or effects of the connection therebetween, in addition to a state in which the member A is directly connected to the member C, or the member B is directly connected to the member C.

Figure 1:
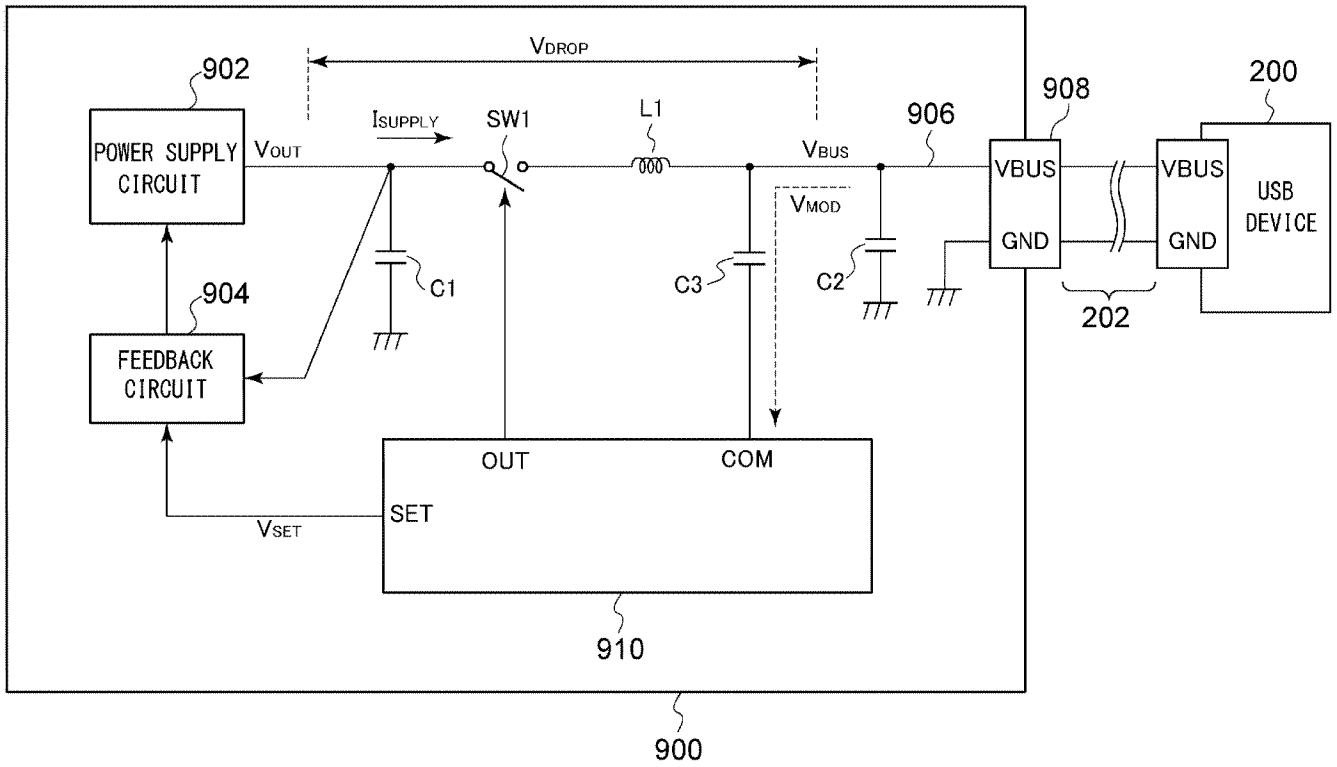
FIG. 1 is a block diagram showing a USB host that conforms to the USB-PD specification investigated by the present inventors.
Figure 2:
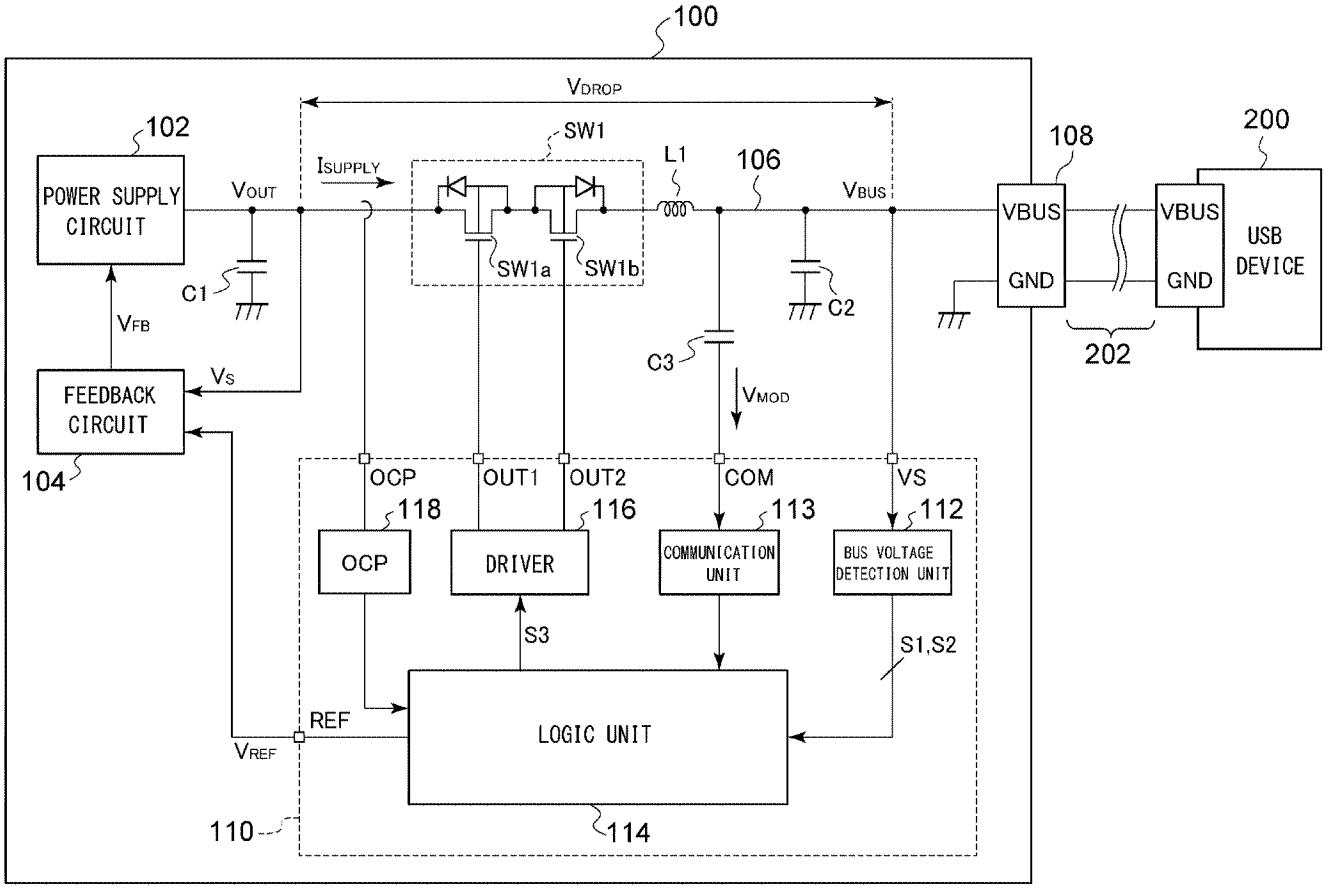
FIG. 2 is a block diagram showing a USB power supply apparatus according to an embodiment.

FIG. 2 is a block diagram showing a USB power supply apparatus 100 according to an embodiment. The USB power supply apparatus 100 conforms to the USB-PD specification. Specifically, the USB power supply apparatus 100 may be configured as a USB host or a USB charger having a host function or otherwise no host function. Alternatively, the USB power supply apparatus 100 may be configured as a USB charger mounted on a dual role terminal of a host device. A USB power reception apparatus 200 that functions as a power supply destination is connected to a receptacle (which will also be referred to as the "USB port" or "USB plug") via a USB cable 202. Typically, the USB power reception apparatus 200 is configured as a USB device. Also, the USB power reception apparatus 200 may be configured as a dual role terminal of a host device or may be configured as a terminal having a host function. In the drawing, only a VBUS line and a GND line are shown.

A power supply circuit 102 generates a DC voltage $V_{OUT}$ to be supplied to a USB power reception apparatus 200. A feedback circuit 104 feedback controls the power supply circuit 102 such that the output voltage $V_{OUT}$ of the power supply circuit 102 approaches a reference voltage $V_{REF}$. A capacitor C1 smooths the output voltage $V_{OUT}$ of the USB power supply apparatus 100.

Specifically, the feedback circuit 104 amplifies the difference between the reference voltage $V_{REF}$ and a detection voltage $V_S$ that corresponds to the output voltage $V_{OUT}$ so as to generate a feedback signal $V_{FB}$, and supplies the feedback signal $V_{FB}$ thus generated to the power supply circuit 102. The power supply circuit 102 receives the feedback signal $V_{FB}$, and adjusts the output voltage $V_{OUT}$ such that the difference between the output voltage $V_{OUT}$ and the reference voltage $V_{REF}$ approaches zero. The configurations of the power supply circuit 102 and the feedback circuit 104 are not restricted in particular. For example, the power supply circuit 102 may be configured as a linear regulator, a step-up or otherwise step-down DC/DC converter, or an AC/DC converter. Also, the power supply circuit 102 may be configured as a combination of these.

A bus line 106 connects the output of the power supply circuit 102 and the receptacle 108. A switch SW1 and an inductor L1 are provided on the bus line 106 path such that they are arranged in series. For example, the switch SW1 includes a pair of N-channel MOSFETs arranged such that they are opposite to each other. A capacitor C2 is connected to the bus line 106 in the vicinity of the receptacle 108, so as to smooth the bus voltage $V_{BUS}$.

The controller 110 integrally controls the overall operation of the USB power supply apparatus 100. The controller 110 has: (i) a function of communicating with the USB power reception apparatus 200 so as to determine the setting voltage $V_{SET}$; (ii) a function of controlling the power supply circuit 102; and (iii) a function of controlling the on/off state of the switch SW1.

The COM terminal of the controller 110 is coupled with the bus line 106 via a capacitor C3. A communication unit 113 receives a modulation voltage $V_{MOD}$ superimposed on the bus voltage $V_{BUS}$, demodulates the modulation voltage $V_{MOD}$, and outputs the demodulated signal to a logic unit 114. The logic unit 114 determines, based on negotiation with the USB power reception apparatus 200, the voltage level (setting voltage $V_{SET}$) of the bus voltage $V_{BUS}$ to be supplied from the USB power supply apparatus 100 to the USB power reception apparatus 200.

Furthermore, with the setting voltage $V_{SET}$ as a base voltage, the logic unit 114 included in the controller 110 adaptively controls the reference voltage $V_{REF}$ used in the feedback circuit 104 according to the electrical state of the USB power supply apparatus 100.

The logic unit 114 controls the on/off state of the switch SW1 according to the electrical state of the USB power supply apparatus 100 or a predetermined sequence. A driver 116 controls the switch SW1 according to a control signal S3 generated by the logic unit 114. For example, the driver 116 includes a charge pump circuit. When an instruction is received to turn on the switch SW1, the driver 116 generates a high-level voltage that is higher than $V_{OUT}$, and supplies the high-level voltage thus generated to the gate of the switch SW1.

An OCP (overcurrent protection) circuit 118 detects the supply current $I_{SUPPLY}$, and compares the supply current $I_{SUPPLY}$ thus detected with an overcurrent threshold value $I_{OCP}$ so as to detect an overcurrent state. When such an overcurrent state is detected, the logic unit 114 switches the switch SW1 to the off state. In addition, the controller 110 may include an OVP (overvoltage protection) circuit or the like. When an overvoltage state is detected, the logic unit 114 may switch the switch SW1 to the off state.

Also, the controller 110 may include a discharge circuit that discharges the charge stored in the output capacitors C1 and C2. Also, the logic unit 114 may control the discharge circuit. It should be noted that the present invention does not relate to such functions, and accordingly, description thereof will be omitted.

Next, description will be made regarding the control operation for the reference voltage $V_{REF}$. Specifically, the controller 110 controls the reference voltage $V_{REF}$ such that a voltage drop that occurs in the bus voltage $V_{BUS}$ from the setting voltage $V_{SET}$ becomes small. The bus voltage $V_{BUS}$ is monitored at a position that is closer to the USB power reception apparatus 200 side than the switch SW1. Preferably, the bus voltage $V_{BUS}$ is monitored in the vicinity of the receptacle 108.

The controller 110 includes a bus voltage detection unit 112 that detects the bus voltage $V_{BUS}$. The logic unit 114 included in the controller 110 controls the reference voltage $V_{REF}$ based on the detection result obtained by the bus voltage detection unit 112.

Figure 3:
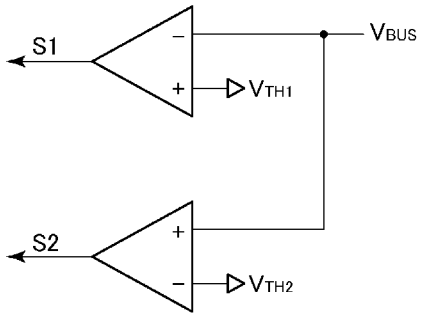
FIG. 3 is a circuit diagram showing an example configuration of a bus voltage detection unit.

FIG. 3 is a circuit diagram showing an example configuration of the bus voltage detection unit 112. The bus voltage detection unit 112 compares the bus voltage $V_{BUS}$ with a first threshold voltage $V_{TH1}$ set to a value that is lower than the setting voltage $V_{SET}$. The bus voltage detection unit 112 generates a low voltage detection signal S1 which is asserted (set to high level, for example) when the bus voltage $V_{BUS}$ becomes lower than the first threshold voltage $V_{TH1}$. Such a function is provided by a first comparator 120. The first threshold voltage $V_{TH1}$ is preferably set to the bus voltage $V_{BUS}$ lower limit voltage prescribed by the specification, or otherwise a value that is slightly higher than the lower limit voltage.

Furthermore, the bus voltage detection unit 112 compares the bus voltage $V_{BUS}$ with a second threshold voltage $V_{TH2}$ set to the setting voltage $V_{SET}$ or otherwise a value defined in the vicinity of the setting voltage $V_{SET}$. The bus voltage detection unit 112 generates a voltage return signal S2 which is asserted (set to high level, for example) when the bus voltage $V_{BUS}$ exceeds the second threshold voltage $V_{TH2}$. This function is provided by a second comparator 122. It should be noted that the first comparator 120 and the second comparator 122 are each configured as an analog voltage comparator. Also, after the bus voltage $V_{BUS}$ is converted into a digital value by means of an A/D converter, the output of the A/D converter may be compared with a digital value that corresponds to the threshold voltage.

Returning to FIG. 2, when the low voltage detection signal S1 is asserted, the logic unit 114 raises the reference voltage $V_{REF}$ by a predetermined voltage increment $\Delta V1$. Conversely, when the voltage return signal S2 is asserted, the logic unit 114 lowers the reference voltage $V_{REF}$ by a predetermined voltage decrement $\Delta V2$. It should be noted that the voltage increment $\Delta V1$ may be the same as the voltage decrement $\Delta V2$. Also, the voltage increment $\Delta V1$ may be larger than the voltage decrement $\Delta V2$.

The logic unit 114 may control the reference voltage $V_{REF}$ in the form of a voltage obtained by superimposing a correction voltage $V_{CMP}$ on the setting voltage $V_{SET}$.

$$V_{REF}=V_{SET}+V_{CMP},$$

The initial value of the correction voltage $V_{CMP}$ is set to zero. When a voltage drop that occurs at the switch SW1, the inductor L1, or an unshown current detection resistor becomes larger, and the bus voltage $V_{BUS}$ becomes lower than the first threshold voltage $V_{TH1}$, i.e., when the low voltage detection signal S1 is asserted, the logic unit 114 may raise the correction voltage $V_{CMP}$. Conversely, when a voltage drop that occurs at the switch SW1 or the inductor L1 becomes smaller, the bus voltage $V_{BUS}$ returns to a normal voltage level (second threshold voltage $V_{TH2}$), i.e., when the voltage return signal S2 is asserted, the logic unit 114 may reduce the correction voltage $V_{CMP}$. The correction voltage $V_{CMP}$ may be changed in a range that is equal to or greater than zero. Also, the range in which the correction voltage $V_{CMP}$ is to be changed may include negative values.

It should be noted that the logic unit 114 preferably raises the reference voltage $V_{REF}$ immediately after the low voltage detection signal S1 is asserted. In contrast, the logic unit 114 preferably lowers the reference voltage $V_{REF}$ after the voltage return signal S2 is continuously asserted for a predetermined judgment time $\tau_{REC}$.

The above is the configuration of the USB power supply apparatus 100. Next, description will be made regarding the operation thereof.

Figure 4:
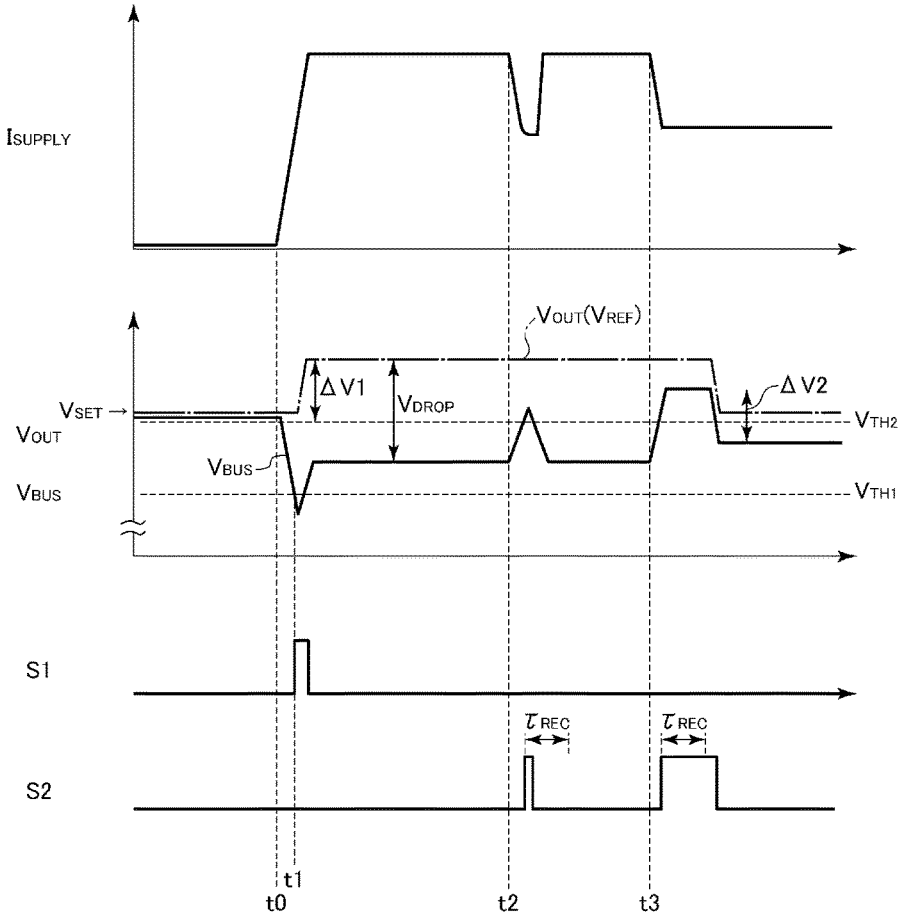
FIG. 4 is an operation waveform diagram showing the operation of the USB power supply apparatus shown in FIG. 2.

FIG. 4 is an operation waveform diagram showing the operation of the USB power supply apparatus 100 shown in FIG. 2. It is needless to say that the switch SW1 is turned on. Before the time point t0, the supply current $I_{SUPPLY}$ is zero. In this stage, the reference voltage $V_{REF}$ is equal to the setting voltage $V_{SET}$ configured as an initial value. It should be noted that description will be made below assuming that there is no response delay between the power supply circuit 102 and the feedback circuit 104. That is to say, the reference voltage $V_{REF}$ and the output voltage $V_{OUT}$ of the power supply circuit 102 are represented by the same waveform.

Before the time point t0, the supply current $I_{SUPPLY}$ is zero. Accordingly, the voltage drop $V_{DROP}$ that occurs between the output of the power supply circuit 102 and the receptacle 118 is substantially zero. That is to say, the relation $V_{BUS}=V_{OUT}$ holds true. In the initial state, the relation $V_{OUT}=V_{REF}=V_{SET}$ holds true. Thus, the bus voltage $V_{BUS}$ is equal to the setting voltage $V_{SET}$.

At the time point t0, the supply current $I_{SUPPLY}$ is raised. The voltage drop $V_{DROP}$ rises according to an increase in the supply current $I_{SUPPLY}$, and accordingly, the bus voltage $V_{BUS}$ drops. When the bus voltage $V_{BUS}$ becomes lower than the first threshold voltage $V_{TH1}$ at the time point t1, the low voltage detection signal S1 is asserted. According to the assertion of this signal, the reference voltage $V_{REF}$ is raised by ΔV1, which raises the output voltage $V_{OUT}$. Furthermore, the bus voltage $V_{BUS}$ is shifted toward the high voltage side by ΔV1, and accordingly, the bus voltage $V_{BUS}$ is returned to a level that is higher than the first threshold voltage $V_{TH1}$.

If the bus voltage $V_{BUS}$ still remains lower than the first threshold voltage $V_{TH1}$ after the reference voltage $V_{REF}$ is shifted once toward the high voltage side, the reference voltage $V_{REF}$ may be shifted once again or may be shifted multiple times in increments of ΔV1 until the low voltage detection signal S1 is negated.

At the time point t2, the supply current $I_{SUPPLY}$ transiently drops during a short period of time due to variation in the load. This temporarily reduces the voltage drop $V_{DROP}$. In this state, the bus voltage $V_{BUS}$ rises and exceeds the second threshold voltage $V_{TH2}$, which asserts the voltage return signal S2. However, the time during which the voltage return signal S2 is asserted is shorter than the judgment time $\tau_{REC}$. Accordingly, the reference voltage $V_{REF}$ is maintained at the same level.

After the time point t3, the supply current $I_{SUPPLY}$ drops so as to steadily remain at a low level. This reduces the voltage drop $V_{DROP}$. In this state, the bus voltage $V_{BUS}$ rises and exceeds the setting voltage $V_{SET}$. In this stage, the bus voltage $V_{BUS}$ exceeds the second threshold voltage $V_{TH2}$, and accordingly, the voltage return signal S2 is asserted. When the time during which the voltage return signal S2 is asserted is longer than the judgment time $\tau_{REC}$, the reference voltage $V_{REF}$ is shifted toward the low voltage side by ΔV2.

Accordingly, the bus voltage $V_{BUS}$ is returned to a value in the vicinity of the setting voltage $V_{SET}$.

The above is the operation of the USB power supply apparatus 100.

With the USB power supply apparatus 100, by adaptively controlling the reference voltage $V_{REF}$, such an arrangement is capable of preventing the bus voltage $V_{BUS}$ from being lower than the lower limit value prescribed by the specification. Thus, such an arrangement provides the USB power supply apparatus 100 with improved load regulation.

In particular, with the embodiment shown in FIG. 2, the bus voltage $V_{BUS}$ at a position in the vicinity of the receptacle 108 is directly monitored. Furthermore, the reference voltage $V_{REF}$ is controlled according to the bus voltage $V_{BUS}$ thus monitored. Such an arrangement is capable of detecting a drop in the bus voltage $V_{BUS}$ in a sure manner. Thus, the reference voltage $V_{REF}$ can be adjusted according to the drop in the bus voltage $V_{BUS}$ thus detected.

Furthermore, the reference voltage $V_{REF}$ is controlled based on the result of the comparison between the bus voltage $V_{BUS}$ and the first threshold voltage $V_{TH1}$. Thus, such an arrangement is capable of preventing the bus voltage $V_{BUS}$ from dropping lower than the first threshold voltage $V_{TH1}$. In other words, the allowed drop in the bus voltage $V_{BUS}$ can be set by setting the first threshold voltage $V_{TH1}$.

Furthermore, the reference voltage $V_{REF}$ is generated by superimposing the correction voltage $V_{CMP}$ on the setting voltage $V_{SET}$. The reference voltage $V_{REF}$ is adjusted by adjusting the correction voltage $V_{CMP}$. With such an arrangement, when the voltage drop $V_{DROP}$ that occurs in the switch or the bus line becomes small, the correction voltage $V_{CMP}$ is set to zero such that the bus voltage $V_{BUS}$ approaches the setting voltage $V_{SET}$. Conversely, when the voltage drop $V_{DROP}$ becomes large, the correction voltage $V_{CMP}$ is raised such that the bus voltage $V_{BUS}$ approaches the setting voltage $V_{SET}$.

Furthermore, when the bus voltage $V_{BUS}$ exceeds the second threshold voltage $V_{TH2}$, the reference voltage $V_{REF}$ is lowered. Thus, such an arrangement is capable of preventing the bus voltage $V_{BUS}$ from continuing in a state in which it exceeds the second threshold voltage $V_{TH2}$. Moreover, by providing the judgment time $\tau_{REC}$, such an arrangement prevents the system from becoming unstable due to transient load variation such as an event at the time point t2 shown in FIG. 4.

The aforementioned effects provided by the USB power supply apparatus 100 are obtained regardless of the setting value of the setting voltage $V_{SET}$. Also, at least one of the parameters that is used (specifically, the first threshold voltage $V_{TH1}$, second threshold voltage $V_{TH2}$, judgment time $\tau_{REC}$, voltage increment ΔV1, voltage decrement Δ2, etc.) may be adjusted according to the setting voltage $V_{SET}$.

Description has been made regarding the present invention with reference to the embodiment. The above-described embodiment has been described for exemplary purposes only, and is by no means intended to be interpreted restrictively. Rather, it can be readily conceived by those skilled in this art that various modifications may be made by making various combinations of the aforementioned components or processes, which are also encompassed in the technical scope of the present invention. Description will be made below regarding such modifications.

[First Modification]

Figure 5:
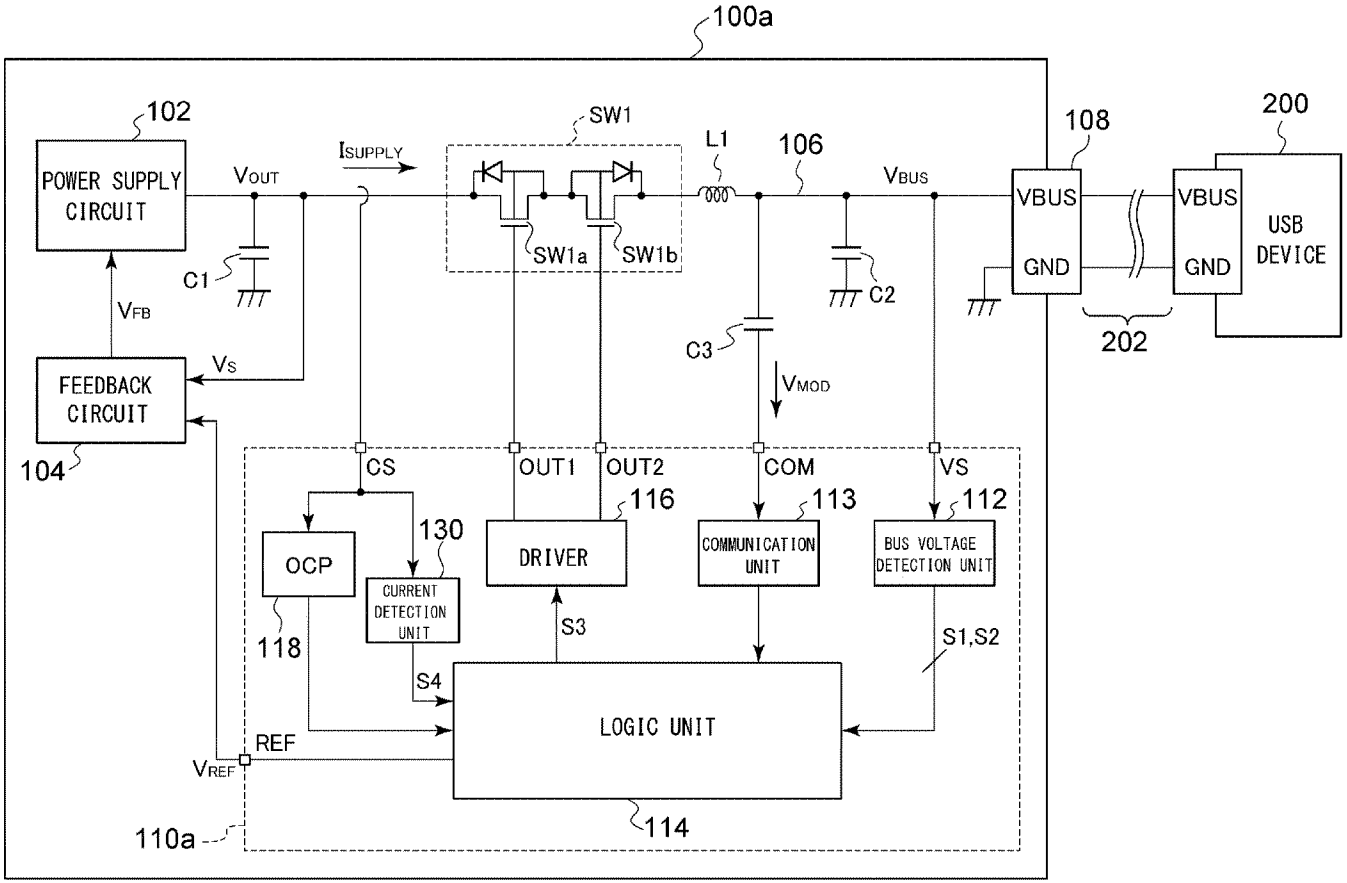
FIG. 5 is a block diagram showing a USB power supply apparatus according to a first modification.

FIG. 5 is a block diagram showing a USB power supply apparatus 100*a* according to a first modification. Description will be omitted regarding the same configuration as that shown in FIG. 2. Only the points of difference will be described. In the USB power supply apparatus 100*a* shown in FIG. 5, a controller 100*a* further includes a current detection unit 130.

The current detection unit 130 detects the supply current $I_{SUPPLY}$. The controller 110*a* controls the reference voltage $V_{REF}$ based on the detection result obtained by the current detection unit 130, in addition to the detection result obtained by the bus voltage detection unit 112. The current detection unit 130 may detect a current at a position that is closer to the power supply circuit 102 side than the switch SW1. Also, the current detection unit 130 may detect a current at a position that is closer to the receptacle 108 side than the switch SW1. A current detection signal S4 generated by the current detection unit 130 may be a signal that represents the result of comparing the supply current $I_{SUPPLY}$ with a predetermined threshold value. Also, the current detection signal S4 may be configured as a digital value obtained by quantizing the supply current $I_{SUPPLY}$.

The smoothing capacitor C2 connected to the bus line 106 has a large capacitance. Accordingly, a delay occurs from the time point at which the supply current $I_{SUPPLY}$ changes to the time point at which the bus voltage $V_{BUS}$ changes. In order to solve such a problem, the logic unit 114 estimates a change in the bus voltage $V_{BUS}$ based on the detection result S4 with respect to the supply current $I_{SUPPLY}$, so as to adjust the reference voltage $V_{REF}$. In other words, the logic unit 114 feedforward controls the reference voltage $V_{REF}$ according to the supply current $I_{SUPPLY}$. Such an arrangement is capable of adjusting the reference voltage $V_{REF}$ based on the prediction before the bus voltage $V_{BUS}$ actually changes. Thus, such an arrangement provides improved responsiveness, thereby suppressing fluctuation in the bus voltage $V_{BUS}$ with higher efficiency.

In other words, it can be said that fluctuation in the bus voltage $V_{BUS}$ in a long time scale is suppressed based on the detection result obtained by the bus voltage detection unit 112. In contrast, fluctuation in the bus voltage $V_{BUS}$ in a short time scale is suppressed based on the detection result obtained by the current detection unit 130.

For example, the current detection unit 130 and the logic unit 114 may detect a change in the supply current $I_{SUPPLY}$ for a predetermined unit of time, and may adjust the reference voltage $V_{REF}$ according to the detection result. Also, the current detection unit 130 may sample the sampling current $I_{SUPPLY}$. In this case, the unit of time may be configured as a sampling period. For example, when an increase in the supply current $I_{SUPPLY}$ measured for the unit of time exceeds a predetermined threshold value, the logic unit 114 may raise the reference voltage $V_{REF}$ by a voltage increment ΔV3. Alternatively, the logic unit 114 may change the voltage increment ΔV3 according to an increase in the supply current $I_{SUPPLY}$ that occurs for every unit of time.

Also, the logic unit 114 may change the reference voltage $V_{REF}$ according to the waveform of the supply current $I_{SUPPLY}$. A part of a circuit configuration of the current detection unit 130 may be shared with the OCP circuit 118. It should be noted that the current detection method employed in the current detection unit 130 or the OCP circuit 118 is not restricted in particular.

[Second Modification]

Figure 6:
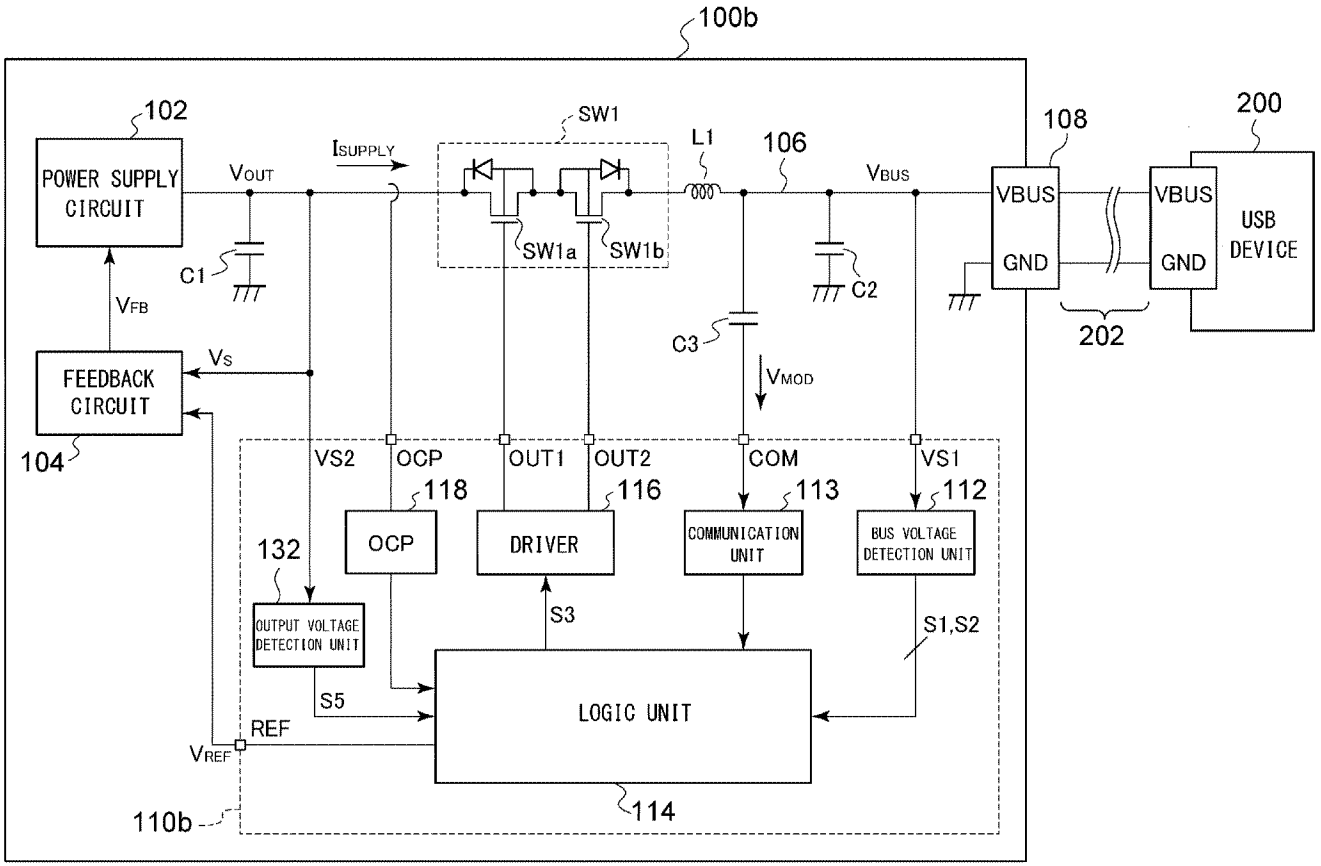
FIG. 6 is a block diagram showing a USB power supply apparatus according to a second modification.

FIG. 6 is a block diagram showing a USB power supply apparatus 100*b* according to a second modification. In the USB power supply apparatus 100*b* shown in FIG. 5, a controller 110*b* further includes an output voltage detection unit 132. The output voltage detection unit 132 detects the output voltage $V_{OUT}$ of the power supply circuit 102. The logic unit 114 controls the reference voltage $V_{REF}$ based on the detection result obtained by the output voltage detection unit 132, in addition to the detection results (S1 and S2) obtained by the bus voltage detection unit 112. A voltage detection signal S5 generated by the output voltage detection unit 132 may be a signal that represents the result of a comparison of the output voltage $V_{OUT}$ of the power supply circuit 102 with a predetermined threshold value. Also, the voltage detection signal S5 may be configured as a digital value obtained by quantizing the output voltage $V_{OUT}$.

A combination of the bus voltage detection unit 112 and the output voltage detection unit 132 can be regarded as a voltage drop detection unit that detects the difference $V_{DROP}$ between the output voltage $V_{OUT}$ of the power supply circuit 102 and the bus voltage V. By measuring the voltage difference $V_{DROP}$ between the output voltage $V_{OUT}$ of the power supply circuit 102 and the bus voltage $V_{BUS}$, and by adjusting the reference voltage $V_{REF}$ according to the voltage drop $V_{DROP}$ thus measured, such an arrangement is capable of controlling the bus voltage $V_{BUS}$ such that it approaches the setting voltage $V_{SET}$.

Furthermore, the measurement result of the output voltage $V_{OUT}$ is effectively used in an operation for a case in which the output voltage $V_{OUT}$ becomes lower than the reference voltage $V_{REF}$ due to the output impedance of the power supply circuit 102. In this case, the voltage difference between $V_{OUT}$ and $V_{REF}$ may be calculated, and the reference voltage $V_{REF}$ may be changed according to the voltage difference thus calculated. Such an arrangement is capable of canceling out the effects of the output impedance of the power supply circuit 102. It should be noted that the output voltage detection unit 132 may be provided as an additional component to the USB power supply apparatus 100*a* shown in FIG. 5.

[Third Modification]

Description has been made with reference to FIG. 5 regarding the USB power supply apparatus 100*a* employing both the bus voltage detection unit 112 and the current detection unit 130. Also, the bus voltage detection unit 112 may be omitted. In this case, the reference voltage $V_{REF}$ may be controlled according to the detection result S4 obtained by the current detection unit 130 alone. In a case in which the impedances of the switch SW1 and the inductor L1 are known, the information with respect to the impedances may be stored in the logic unit 114. With such an arrangement, the logic unit 114 may calculate the voltage drop $V_{DROP}$ by multiplying the measurement value of the supply current $I_{SUPPLY}$ by the impedance thus stored, and may set the reference voltage $V_{REF}$ based on the voltage drop $V_{DROP}$ thus calculated.

[Fourth Modification]

Description will be made with reference to FIG. 6 regarding the USB power supply apparatus 100*b* employing a combination of the bus voltage detection unit 112 and the output voltage detection unit 132. Also, an arrangement may be made employing a combination of the current detection unit 130 and the output voltage detection unit 132.

[Fifth Modification]

Figure 7:
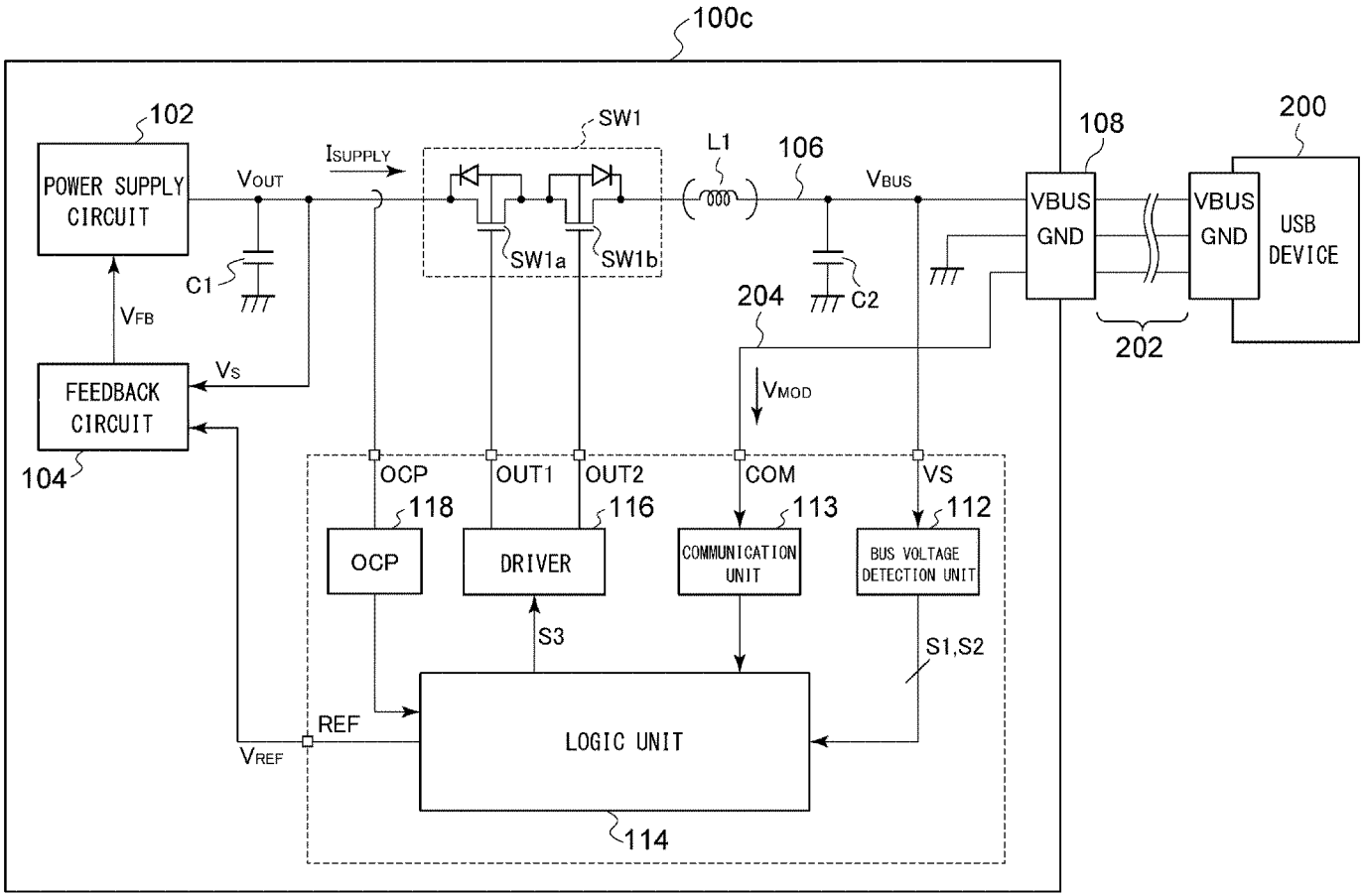
FIG. 7 is a block diagram showing a USB power supply apparatus according to a fifth modification.

Description has been made in the embodiment regarding the USB power supply apparatus 100 that conforms to the USB-PD specification. Also, the present invention is applicable to an arrangement that conforms to the USB Type-C specification. FIG. 7 is a block diagram showing a USB power supply apparatus 100*c* according to a fifth modification. With the USB Type-C specification, a controller 110*c* and the power supply reception apparatus 200 communicate with each other via a dedicated line 204. That is to say, the modulation voltage $V_{MOD}$ is not superimposed on the bus voltage $V_{BUS}$. Thus, such an arrangement does not require the capacitor C3 shown in FIG. 2. Also, the inductor L1 may be omitted. The other configuration is the same as that shown in FIG. 2.

[Usage]

Figure 8:
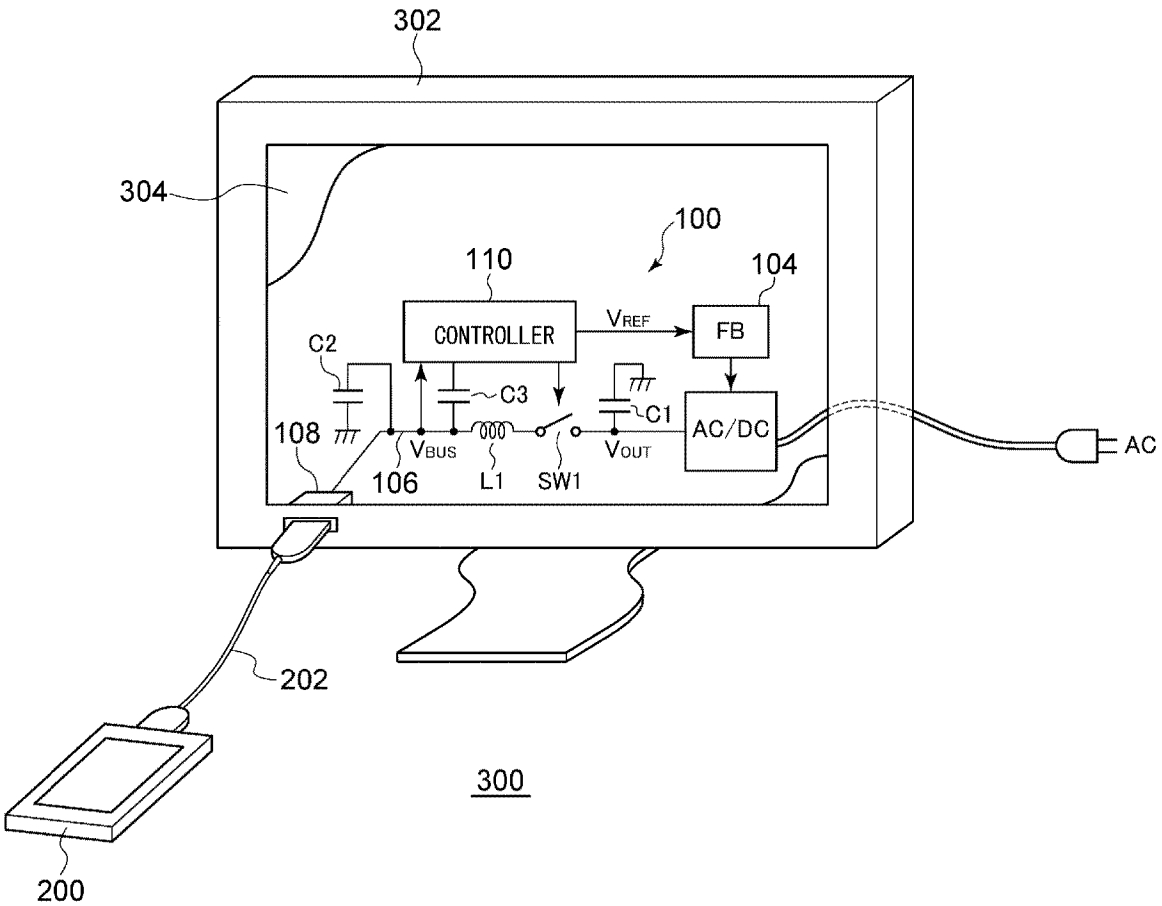
FIG. 8 is a perspective view of an electronic device including a USB power supply apparatus.

Lastly, description will be made regarding the usage of the USB power supply apparatus 100. FIG. 8 is a perspective view of an electronic device 300 including the USB power supply apparatus 100. The electronic device 300 is configured as a TV, a liquid crystal display, a laptop computer, or the like.

The electronic device 300 includes a casing 302, a display panel 304, and the aforementioned USB power supply apparatus 100. The power supply circuit 102 included in the USB power supply apparatus 100 is configured as an AC/DC converter. The power supply circuit 102 converts an AC voltage $V_{AC}$ into a DC voltage $V_{OUT}$. The setting voltage $V_{SET}$ for the DC voltage $V_{OUT}$ is selected by the controller 110. The receptacle 108 is provided on a front face or otherwise a back face of the casing 302, which allows the USB cable 202 to be inserted into the receptacle 108.

It should be noted that the electronic device 300 may be configured as a cellular phone terminal, a tablet terminal, a digital still camera, a digital video camera, or the like.

While the preferred embodiments of the present invention have been described using specific terms, such description is for illustrative purposes only, and it is to be understood that changes and variations may be made without departing from the spirit or scope of the appended claims.

What is claimed is:

1. A USB power supply apparatus that conforms to the USB (Universal Serial Bus) specification, and that supplies electric power to a USB power reception apparatus, the USB power supply apparatus comprising:

a power supply circuit;

a bus line structured to connect an output of the power supply circuit and the USB power reception apparatus;

a switch provided on a path of the bus line;

a feedback circuit structured to feedback control the power supply circuit such that the output voltage of the power supply circuit approaches a reference voltage; and a controller structured to adaptively control the reference voltage based on an electrical state of the USB power supply apparatus;

wherein the controller controls the reference voltage so as to reduce an amount of a drop in voltage from a predetermined setting voltage that occurs in a bus voltage at a position that is closer to the USB power reception apparatus side than the switch;

wherein the controller comprises a bus voltage detection unit structured to detect the bus voltage, wherein the controller controls the reference voltage based on a detection result obtained by the bus voltage detection unit;

wherein the bus voltage detection unit compares the bus voltage with a first threshold voltage determined to be lower than the setting voltage, and generates a low voltage detection signal which is asserted when the bus voltage becomes lower than the first threshold voltage;

wherein, when the low voltage detection signal is asserted, the controller raises the reference voltage by a predetermined voltage increment;

wherein the bus voltage detection unit compares the bus voltage with a second threshold voltage that is set to the setting voltage or otherwise a value in the vicinity of the setting voltage;

wherein the bus voltage detection unit generates a voltage return signal that is asserted when the bus voltage exceeds the second threshold voltage;

and wherein, when the voltage return signal is asserted, the controller lowers the reference voltage by a predetermined voltage decrement.

2. The USB power supply apparatus according to claim 1, wherein the reference voltage is configured as a voltage obtained by superimposing a correction voltage on the setting voltage, and wherein, when the low voltage detection signal is asserted, the controller raises the correction voltage by a predetermined voltage increment.

3. The USB power supply apparatus according to claim 1, wherein the reference voltage is configured as a voltage obtained by superimposing a correction voltage on the setting voltage, and wherein, when the voltage return signal is asserted, the controller reduces the correction voltage by a predetermined voltage decrement.

4. The USB power supply apparatus according to claim 1, wherein, when the voltage return signal remains in an asserted state for a predetermined judgment time, the controller lowers the reference voltage.

5. The USB power supply apparatus according to claim 1, wherein the controller further comprises a current detection unit structured to detect a supply current which is supplied to the USB power reception apparatus via the bus line, and wherein the controller controls the reference voltage based on a detection result obtained by the current detection unit in addition to the detection result obtained by the bus voltage detection unit.

6. The USB power supply apparatus according to claim 1, wherein the controller further comprises an output voltage detection unit structured to detect an output voltage of the power supply circuit, and wherein the controller controls the reference voltage based on a detection result obtained by the output voltage detection unit in addition to the detection result obtained by the bus voltage detection unit.

7. The USB power supply apparatus according to claim 1, wherein the controller comprises a current detection unit structured to detect a supply current supplied to the USB power reception apparatus via the bus line, and wherein the controller controls the reference voltage based on a detection result obtained by the current detection unit.

8. The USB power supply apparatus according to claim 7, wherein the reference voltage is configured as a voltage obtained by superimposing a correction voltage on a predetermined setting voltage, and wherein the controller adjusts the correction voltage so as to reduce an amount of a drop in voltage from a predetermined setting voltage that occurs in a bus voltage at a position that is closer than the USB power reception apparatus side than the switch.

9. The USB power supply apparatus according to claim 8, wherein the controller further comprises a communication unit structured to communicate with the USB power reception apparatus, and wherein the controller determines the setting voltage based on negotiation with the USB power reception apparatus.

10. The USB power supply apparatus according to claim 1, wherein the controller comprises a voltage drop detection unit structured to detect a difference between an output voltage of the power supply circuit and a bus voltage at a position that is closer to the USB power reception apparatus side than the switch, and wherein the controller controls the reference voltage based on a detection result obtained by the voltage drop detection unit.

11. The USB power supply apparatus according to claim 1, that conforms to the USB-PD (Power Delivery) specification, further comprising an inductor provided at a position that is closer to the USB power reception apparatus side than the switch, wherein the controller controls the reference voltage so as to reduce an amount of voltage drop from a predetermined setting voltage that occurs in a bus voltage at a position that is closer to the USB power reception apparatus side than the inductor.

12. The USB power supply apparatus according to claim 1, that conforms to the USB-PD (Universal Serial Bus-Power Delivery) specification or otherwise the USB Type-C specification.

13. An electronic device comprising the USB power reception apparatus according to claim 1.

* * * * *